US005772042A

United States Patent [19]

Nott et al.

[11] Patent Number: 5,772,042

[45] Date of Patent: Jun. 30, 1998

[54] METHOD OF MINERAL ORE FLOTATION BY ATOMISED THIOL COLLECTOR

[75] Inventors: Mark Cleeton Nott, Kenmore; Jonathan James Davies; Emmanuel Manlapig, both of Chapel Hill, all of Australia

[73] Assignee: University of Queensland, Queensland, Australia

[21] Appl. No.: 535,040

[22] PCT Filed: Apr. 15, 1994

[86] PCT No.: PCT/AU94/00194

§ 371 Date: Dec. 18, 1995

§ 102(e) Date: Dec. 18, 1995

[87] PCT Pub. No.: WO94/23841

PCT Pub. Date: Oct. 27, 1994

[30] Foreign Application Priority Data

Apr. 16, 1993 [AU] Australia ..... PL8332

[51] Int. Cl.[6] ..... B03D 1/02; B03D 1/06; B03D 1/012

[52] U.S. Cl. ..... 209/166; 252/61

[58] Field of Search ..... 209/166, 167; 252/61

[56] References Cited

U.S. PATENT DOCUMENTS

| | | |
|---|---|---|
| 1,350,364 | 8/1920 | Dosenbach . |
| 1,354,031 | 9/1920 | Dosenbach . |
| 1,365,281 | 1/1921 | Scott . |
| 1,418,514 | 6/1922 | Bailey . |
| 1,508,478 | 9/1924 | Scott . |
| 3,033,363 | 5/1962 | Weston . |
| 3,202,281 | 8/1965 | Weston . |
| 3,255,999 | 6/1966 | Weston . |
| 4,410,439 | 10/1983 | Crozier . |

*Primary Examiner*—Thomas M. Lithgow
*Attorney, Agent, or Firm*—Sheridan Ross P.C.; Douglas Swartz

[57] ABSTRACT

A method for the flotation processing of mineral ores is disclosed. At least one collector is introduced into the flotation process by atomization. In a preferred aspect of the invention, the collector is provided as a mixture of the thiol and corresponding oxidized thiol (e.g., a dithiol).

17 Claims, 3 Drawing Sheets

METHOD OF MINERAL ORE FLOTATION BY ATOMISED THIOL COLLECTOR

This invention relates to the processing of mineral ores. More specifically, it is directed to improvements in the froth flotation separation process, particularly with respect to the collectors used in such a process.

Froth flotation is an important and versatile mineral-processing technique whereby the mining of low-grade and complex ore bodies can be undertaken which otherwise would be regarded as uneconomic. Froth flotation of minerals have been practised for many years and is the main procedure for processing sulphide minerals. Whilst the theory of froth flotation is complex and not yet fully understood, it is well known that the process utilizes the differences in physico-chemical surface properties of the various minerals. After treatment with reagents, such differences in surface properties become apparent. For flotation to take place, an air-bubble must be able to attach itself to a particle, and lift it to the water surface. The process can only be applied to relatively fine particles, because if they are too large the adhesion between the particle and the bubble will not support particle weight and the bubble will therefore drop its load.

The air-bubbles can only stick to the mineral particles if they can displace water from the mineral surface, which can only occur if the mineral is, at least to some extent, hydrophobic. Having reached the surface, the air-bubbles can only continue to support the mineral particles if they can form a stable froth, otherwise they will burst and drop the mineral particles. To achieve these conditions, it is necessary to use various chemical reagents such as frothers, collectors and modifiers as are well known in the art.

As most minerals are not water repellent in their natural state, the most important of these flotation reagents are the collectors. These collectors adsorb onto the mineral surface, rendering it hydrophobic and facilitating bubble attachment. The collectors are organic compounds which render selected minerals water-repellent by adsorption of molecules or ions onto the mineral surface, reducing the stability of the hydrated layer separating the mineral surface from the air-bubble to such a level that attachment of the particle to the bubble can be made on contact.

Collector molecules may be ionizing compounds, which dissociate into ions in water, or non-ionizing compounds, which are practically insoluble, and render the mineral water-repellent by covering its surface with a thin film.

The most widely used collectors are of the sulphydryl type, which contain a polar bivalent sulphur group. These collectors are very powerful and selective in the flotation of sulphide minerals and the most widely used of these collectors are the xanthates, dithiophosphates and dithiocarbamates. Of these, the xanthates are most important for sulphide mineral flotation. See Crozier (*Flotation, Theory, Reagents and Ore Testing*, Pergamon Press, 1992) which is incorporated herein by reference.

Conventionally, collectors are added to the flotation pulp during or subsequent to grinding or during the flotation procedure itself.

Collectors such as xanthates adsorb from the liquid to the sulphide mineral surface. This forms the hydrophobic identity on the sulphide mineral surface. Once in the flotation cell, this sulphide mineral is then captured by the introduced air bubbles and subsequently recovered.

Xanthates and similar thiol compounds can also oxidize and the obtained dixanthogens and similar products of the oxidation are themselves collectors. Some limited attempts have been made to utilize these oxidation products as the principal collectors and prior art includes the deliberate electrochemical oxidation of xanthates to dixanthogens before their addition to flotation cells or conditioning tanks. However, since the dixanthogens have limited solubility in the flotation pulp they have not found commercial use.

The inventors have found that an improvement in flotation separation and recovery of desired sulphide minerals can be achieved where collector reagents are introduced into the flotation process by atomization.

In a first aspect of this invention, there is provided a method for the flotation processing of mineral ores utilizing at least one thiol collector, wherein said at least one thiol collector is introduced into the flotation process by atomization. Preferably, the thiol collector is provided as a mixture of a thiol and corresponding oxidized thiol (dithiol).

The thiol or mixed thiol/diothiol collector may be introduced into the flotation pulp prior to and/or during flotation. Multiple addition of collector reagents may be made throughout the flotation process as desired.

The addition of flotation collectors to the pulp is by atomization. Atomization results from an energy source acting on a bulk liquid. The applied force results in liquid break up and disintegration and hence droplet formation. A range of atomizing techniques may be used to produce atomized thiol collectors. See Kirk Othmer, *Encyclopedia of Chemical Technology*, Vol 10, at pages 609–610 which is incorporated herein by reference. Various atomization techniques which may be used in the invention include:

(i) centrifugal atomizers (for example, rotating cup atomizers), (ii) pressure atomizers (for example, liquid pressure atomizers), (iii) kinetic or sonic atomizers (for example, venturi type atomizers), (iv) ultrasonic atomizers, and (v) pneumatic atomizers (for example, air-liquid atomizers).

The atomized collector droplets are dispersed in air which is then introduced into the flotation pulp. Any of the aforementioned atomization techniques can be used to produce droplet sizes from submicron to approximately 0.5 millimeter diameter. If droplet sizes are too large the thiol or thiol/dithiol mixture cannot be effectively distributed. Conventional test procedures may be employed to ascertain optimum droplet size range for specific flotation conditions. By way of example, atomized thiol and/or dithiol collectors may comprise a droplet diameter from 0.1 micron to 500 microns and more particularly may comprise a droplet diameter from 5 to 75 microns.

Conventional apparatus known for producing atomized solutions may be used to introduce atomized collectors into the flotation pulp either prior to or during the flotation process.

Thiol collectors may be partially oxidized to provide a mixture of thiol and the corresponding dithiol which may be subsequently atomized for introduction into the flotation pulp. Oxidation of thiol collectors may be achieved by various means including: electrochemical oxidation in an electrochemical cell; chemical oxidation utilizing an oxidation reagent such as potassium permanganate or hypochlorite; use of a catalyst, and other oxidation techniques as are well known in the art.

The mixture of thiol and the corresponding dithiol may be as a result of partial oxidation of the thiol, or alternatively the oxidized thiol may be added to non-oxidized material to provide a mixture.

In a preferred aspect of this invention, the ratio of thiol to dithiol will vary according to the sulphide mineral ore being processed. As described hereinafter, the optimum ratio of the dithiol to thiol collector used in the flotation of two specific sulphide ore deposits varied from 6% weight dithiol in relation to a nickel deposit to 14% weight dithiol in relation to a copper deposit. Conventional trial and experiment will be required to determine the optimum proportion of thiol to dithiol for a particular sulphide ore deposit in order to maximize recovery and selectively during flotation processing. The ratio of dithiol to thiol in a collector may be from 0% to 100%.

Any thiol collector known in the art for flotation processing of sulphide minerals may be utilized in the invention, such as xanthate, dithiophosphate, dialkyl thionocarbamate, mercaptan, mercaptobenzothiazole, or thiocarbanilide. Examples of such compounds include the potassium and sodium salts of xanthates including all the homologues thereof such as ethyl, iso-butyl, n-butyl, propyl, amyl, and decyl xanthates; the salts of o,o, dialkyl dithiophosphates including homologues thereof; 2-mercaptobenzothiazole, and the like. Particularly preferred according to this invention are xanthate collectors such as potassium ethyl xanthate, sodium ethyl xanthate, potassium isopropyl xanthate, sodium isopropyl xanthate, sodium isobutyl xanthate, sodium sec butyl xanthate, potassium sec amyl xanthate, potassium amyl xanthate, sodium isoamyl xanthate and potassium hexyl xanthate.

The metals commonly recovered as sulphide minerals include those of nickel, copper, lead, zinc and iron. The invention includes the use of multiple collector reagents in flotation processes and oxidized forms thereof. For example, different thiol collectors may be combined prior to flotation. For example, collectors may comprise a mixture of any of xanthate, dithiophosphate, dialkyl thionocarbamate, mercaptan, mercaptobenzothiazole, or thiocarbanilide collectors.

In a further aspect, this invention extends to a sulphide mineral or minerals recovered according to methods described herein, as well as the metal derived from such sulphide mineral, as a result of conventional processing.

Without limiting the invention in any sense, one hypothesis for the improved separation and recovery of sulphide minerals according to various aspects of the invention is that the product of atomization of the mixed flotation reagent (thiol/dithiol) exists produced exists predominantly at the bubble/liquid interface. The dithiol may reduce the diffusion of the anionic thiol from the bubble/pulp interface to the flotation pulp. The reduced diffusion may be achieved due to the coadsorption of hydrocarbon groups of the insoluble dithiol to the anionic thiol. This may result in a distinctly different mechanism of attachment of thiol collectors to the sulphide mineral surface compared to prior art approaches. By the introduction of mixed thiol and dithiol by atomization, two distinctive mechanisms for the adsorption of the thiol/dithiol collector onto the sulphide mineral may operate. One mechanism may involve the diffusion of the thiol/dithiol away from the bubble interface to the liquid phase. From the liquid the attachment to the sulphide mineral may be according to previously described mechanisms. The other mechanism may involve the uptake of a thiol/dithiol from the bubble surface by the sulphide mineral. This may occur either by the collision or contact of the sulphide mineral with the thiol/dithiol laden bubble.

This invention will now be described with reference to two specific ore deposits, namely Leinster nickel open cut ore and Cobar chalcopyrite/pyrite ore. It is to be understood that the invention is not limited to the specific ore deposits nor the specific minerals involved which are described hereinafter merely as illustrative examples.

BRIEF DESCRIPTION OF THE DRAWINGS

Figures

EXAMPLE 1

Leinster Nickel Open Cute Ore

A series of flotation tests were conducted on a violarite/pyrite ore from the Leinster ore body. This ore contains 6 wt % violarite as the valuable nickel sulphide and 15 wt % pyrite as a gangue sulphide mineral. Tests were conducted to compare;

(i) The use of atomized solutions of xanthate and dixanthogen, and (ii) The current conventional practise of adding a solution of xanthate to the flotation pulp during a conditioning time prior to flotation.

Both test conditions were performed with the following reagent dosages;

(i) Interfroth 56 (trade name for a triethoxybutane type frother, Chemical Mining Services)—30 g/t, (ii) Soda Ash to pH 8.5, (iii) Carboxy Methyl Cellulose—200 g/t, and (iv) Potassium Amyl Xanthate—300 g/t.

Figure 1:
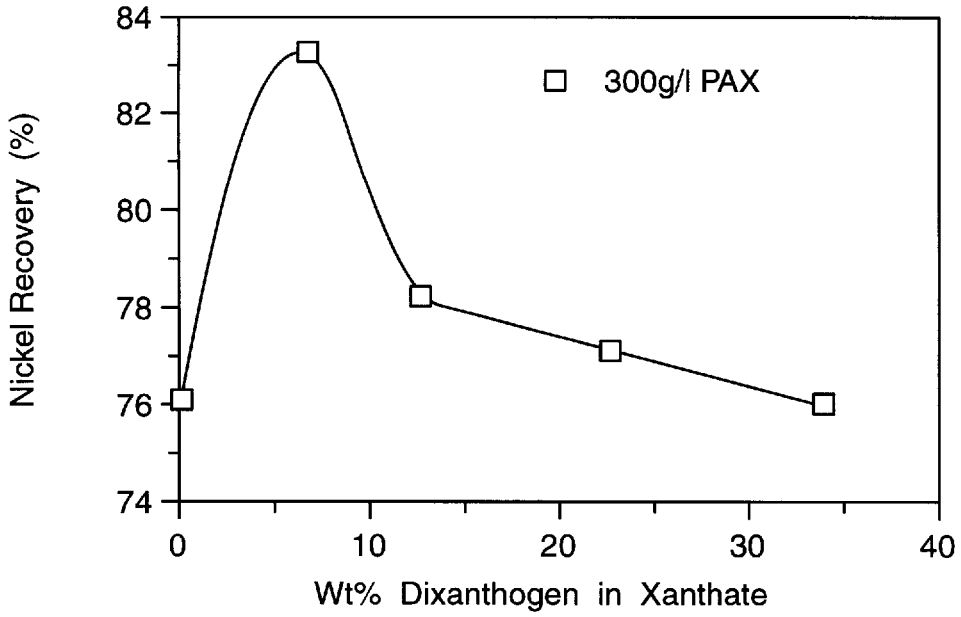
FIG. 1: Nickel recovery with weight percent dixanthogen in xanthate for a constant potassium amyl xanthate dosage 300 g/t.

For the atomized solutions of xanthate and dixanthogen the ratio of wt % dixanthogen in xanthate was varied from 0% to 35%. We have found that an optima exists in nickel recovery in this ore for a solution containing 6 wt % dixanthogen in xanthate (FIG. 1). When an atomized solution of 6 wt % dixanthogen in xanthate is used a seven percent absolute increase in nickel recovery is obtained over the current conventional technique (that is, addition of a xanthate solution to the mineral pulp).

The ore in this example was crushed to a $P_{80}$ of 75 microns. The processing apparatus was a conventional laboratory scale flotation cell. Examples of commonly used flotation processing equipment are described for example, in Kirk Othmer, *Encyclopedia of Chemical Technology*, Vol 10, at pages 523–547, which is incorporated herein by reference. The solids content of the pulp was 30%.

Figure 2:
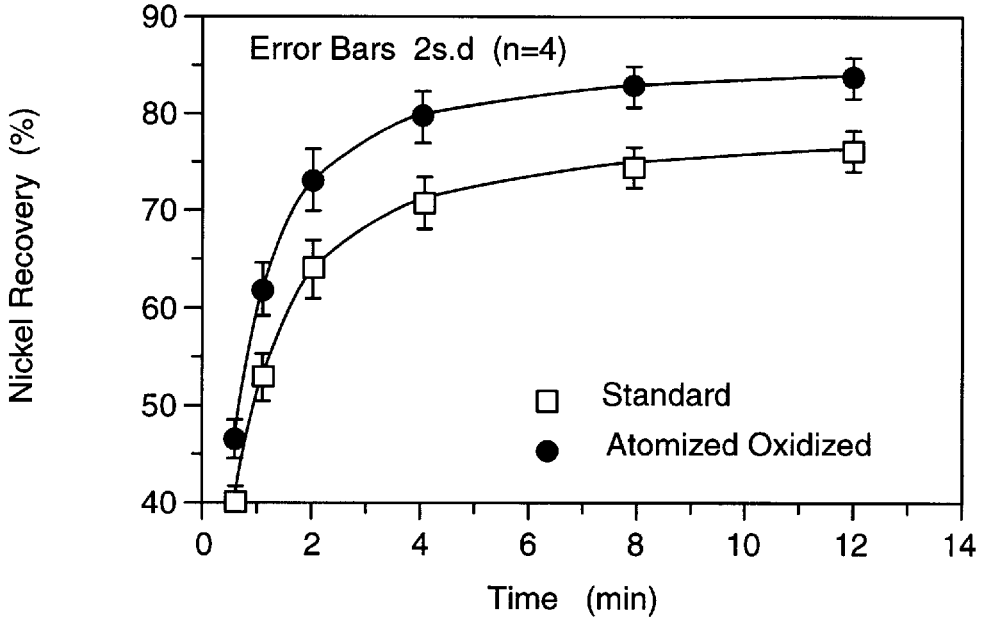
FIG. 2: A comparison of nickel flotation rate for a standard test and a 6 wt % dixanthogen in xanthate solution test.

Atomized conditioning of 6 wt % dixanthogen in xanthate showed that an improvement in nickel flotation rate can be obtained over current conventional practise. This means that atomized conditioning of xanthate/dixanthogen solutions can extract the nickel from the ore at a faster rate (FIG. 2) during flotation.

Figure 3:
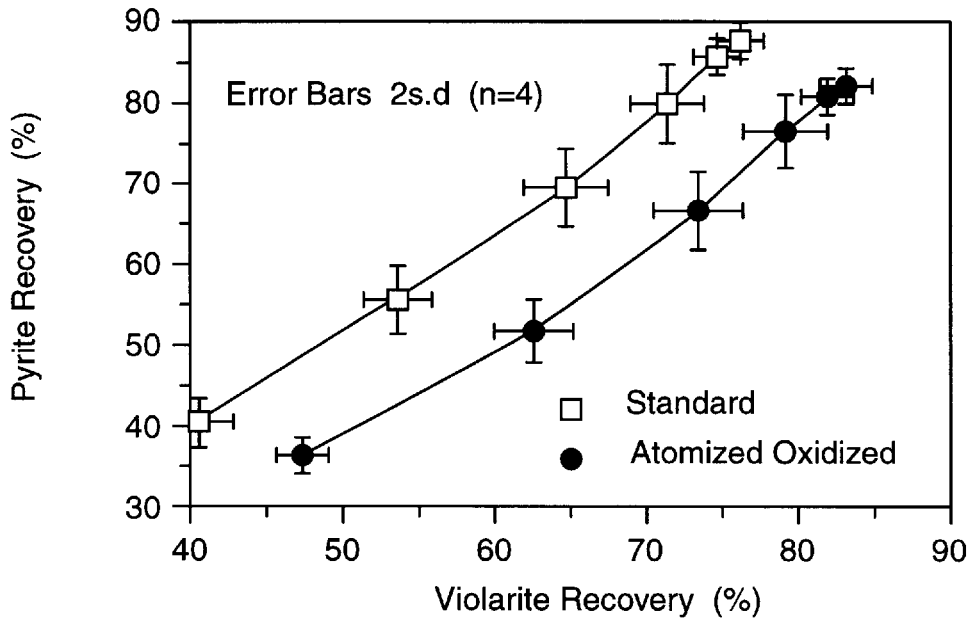
FIG. 3: A comparison of the violarite/pyrite selectivity for the average standard tests and average 6 wt % dixanthogen in xanthate solution tests.

As well as increasing the rate and recovery of nickel, atomized conditioning of mixed solutions of xanthate and dixanthogen can result in selectivity improvements of nickel against pyrite when compared to current conventional practise (FIG. 3).

A second series of tests was conducted to determine the difference between the following test conditions.

(i) Current conventional technique of adding a xanthate solution to the pulp.

(ii) Adding the xanthate/dixanthogen solution to the pulp.

(iii) Atomized conditioned mixes of xanthate and dixanthogen.

These tests were undertaken using the same reagents and reagent dosages as the first series of tests previously mentioned. In Table 1 the average nickel recovery, average nickel concentrate grade and pyrite recovery produced is compared for the three cases outlined above.

TABLE 1

A comparison of the means of nickel recovery, nickel grade and pyrite recovery for the three cases.

| | Standard[1] (Conventional) | Atomized[2] Thiol/Dithiol | Thiol/Dithiol[3] |
|---|---|---|---|
| Mean Ni Recovery | 67.48 | 73.04 | 76.39 |
| Ni recovery s. dev | 2.00 | 0.32 | 1.20 |
| Mean Ni grade | 7.77 | 6.67 | 5.39 |
| Ni Grade s. dev | 0.80 | 0.34 | 0.97 |
| Mean Pyrite Recovery | 75.9 | 70.43 | 89.32 |
| Pyrite Recovery s. dev | 5.30 | 5.50 | 3.12 |

[1]Xanthate solution addition to pulp.
[2]Thiol/dithiol atomization addition to pulp.
[3]Thiol/dithiol added to pulp.

Figure 4:
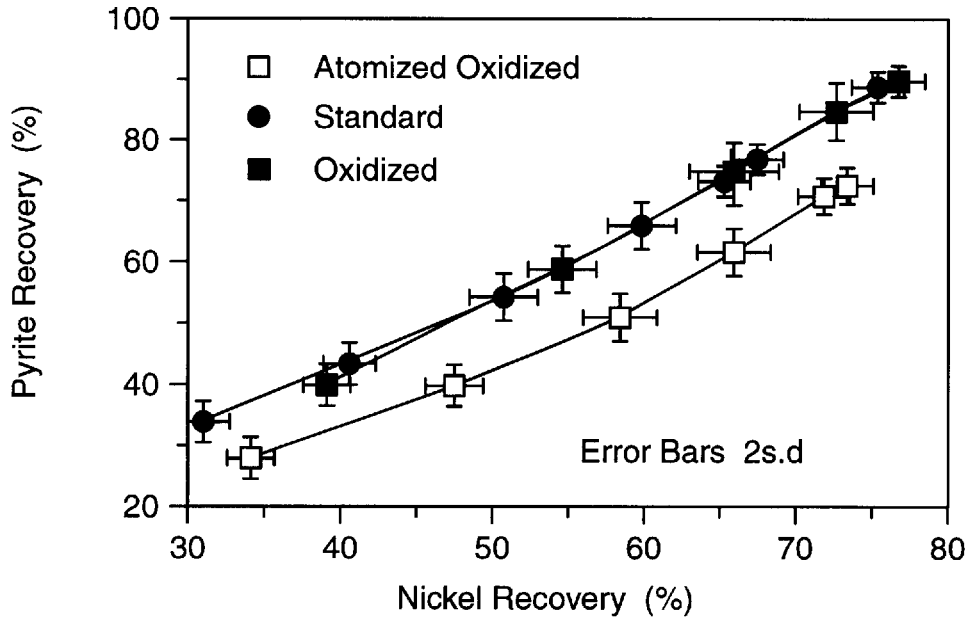
FIG. 4: A comparison of the violarite/pyrite selectivity for the average standard tests, average 6 wt % dixanthogen in xanthate atomized test and average 6 wt % dixanthogen in xanthate non-atomized test.

Although the addition of mixed xanthate/dixanthogen to the pulp phase has improved nickel recovery over both the standard and atomized xanthate/dixanthogen conditions, the selectivity against pyrite is significantly worse when compared to the atomized xanthate/dixanthogen tests (FIG. 4). This indicates that introducing the xanthate/dixanthogen into the flotation pulp is no more selective against pyrite than the conventional practise of adding the xanthate. The only method of achieving both increased nickel recovery and selectivity against pyrite is by atomizing the xanthate/dixanthogen solution and introducing the same to the pulp.

EXAMPLE 2

Cobar Chalcopyrite/Pyrite Ore

To demonstrate that atomized conditioning of thiol/dithiol solutions are applicable for a range of sulphide minerals a second series of tests were conducted on a chalcopyrite/pyrite ore sample. This ore consists of 10 wt % chalcopyrite as the valuable sulphide mineral and 22 wt % pyrite present as a gangue sulphide mineral. In this example the following conditions were compared.

(i) Current conventional technique of conditioning with xanthate.

(ii) Adding the xanthate/dixanthogen solution to the pulp.

(iii) Atomized conditioned mixes of xanthate and dixanthogen.

The test conditions were performed with the following reagent dosages;

(i) Interfroth 50 (trade name for a triethoxybutane type frother)—20 g/t, (ii) Sodium Sulphite—200 g/t, (iii) Lime—pH 9.5, and (iv) Sodium iso-Butyl Xanthate—15 g/t.

For the atomized conditioned solution of xanthate and dixanthogen the ratio of wt % dixanthogen in xanthate was varied from 0% to 20%. In Table 2 the average copper recovery, copper grade and pyrite recovery produced is compared for the three cases. For the tests where a mixture of xanthate and dixanthogen was used a ratio of 14 wt % dixanthogen in xanthate was used.

TABLE 2

A comparison of the means of copper recovery, copper grade and pyrite recovery for the three cases.

| | Standard[1] (Conventional) | Atomized[2] Thiol/Dithiol | Thiol/Dithiol[3] |
|---|---|---|---|
| Mean Cu Recovery | 92.25 | 97.55 | 88.28 |
| Cu recovery s. dev | 1.85 | 0.50 | 1.50 |
| Mean Cu grade | 12.98 | 15.91 | 13.29 |
| Cu Grade s. dev | 0.40 | 0.16 | 0.64 |
| Mean Pyrite Recovery | 56.07 | 38.36 | 50.18 |
| Pyrite Recovery s. dev | 3.50 | 2.6 | 4.70 |

[1,2,3]See Table 1 Legend

Figure 5:
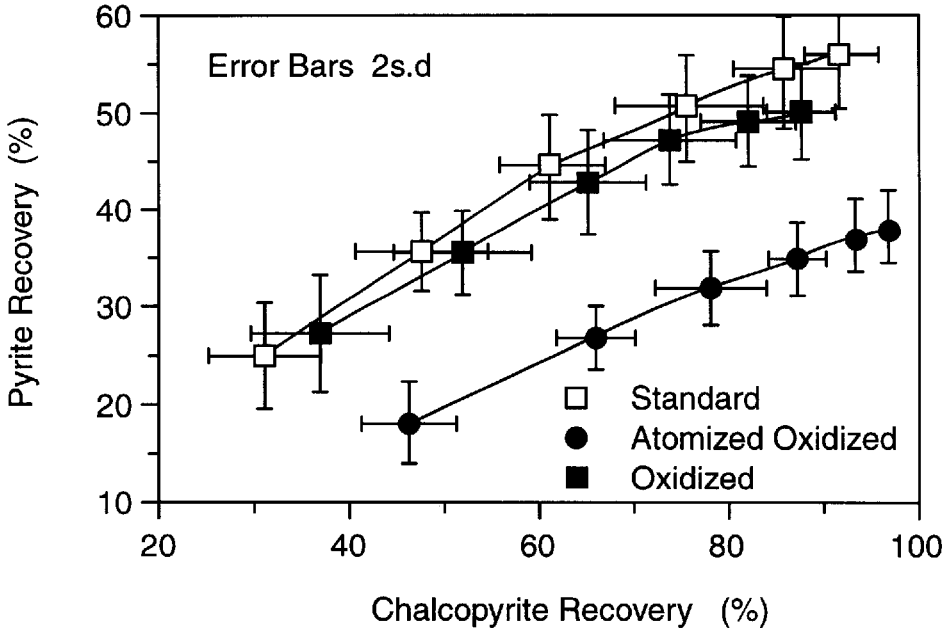
FIG. 5: A comparison of copper flotation rate for a standard test, an atomized 14 wt % dixanthogen in xanthate solution test and a 14 wt % dixanthogen in xanthate non-atomized test.
Figure 6:
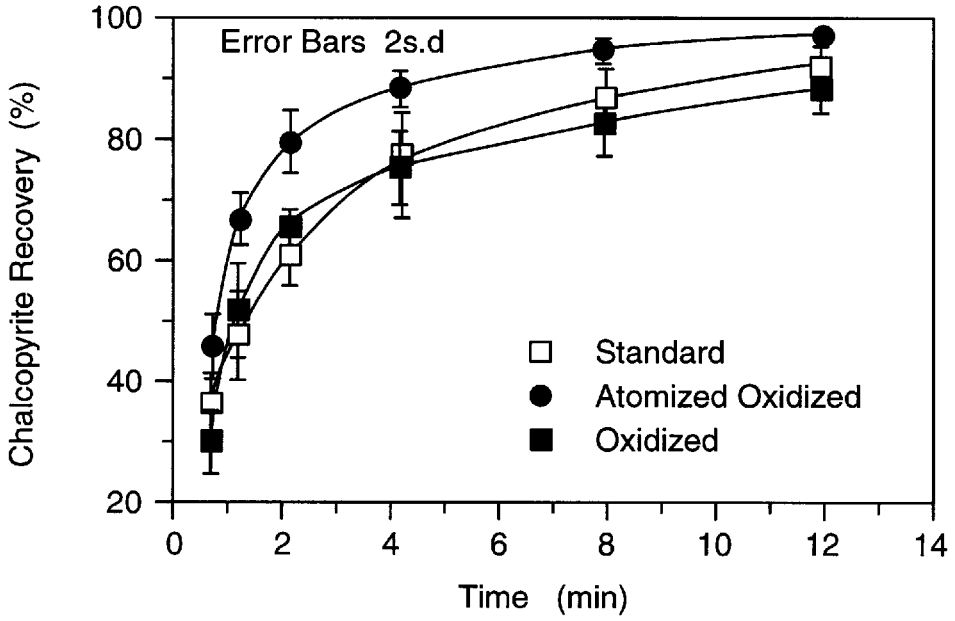
FIG. 6: A comparison of the chalcopyrite/pyrite selectivity for the average standard tests, average 14 wt % dixanthogen in xanthate atomized test and average 14 wt % dixanthogen in xanthate non-atomized test.

Table 2 shows that when a 14 wt % dixanthogen in xanthate solution is introduced during conditioning time by atomization copper recovery is increased and pyrite recovery is reduced compared to both the current conventional technique and to the technique of adding the thiol/dithiol to the flotation pulp. By atomized conditioning of the thiol and dithiol an increase in copper flotation rate compared to the other two methods can be shown (FIG. 5). Atomized conditioning the dixanthogen and xanthate solution also results in selectivity improvements of the chalcopyrite mineral against pyrite (FIG. 6).

The optimum ratio of dixanthogen in xanthate solution is different depending on the minerals being treated. The flotation enhancement described herein is generally applicable to sulphide mineral systems with examples of a chalcopyrite/pyrite and violarite/pyrite ore being specifically set forth herein. It has been shown that atomized conditioning of thiol/dithiol solutions compared to current techniques will result in improvements in flotation separation, namely;

(i) An increased recovery of the valuable mineral, (ii) An increase in the flotation rate of the valuable mineral, and (iii) A decrease in the recovery of gangue sulphide minerals such as pyrite.

The term "conditioning" as used herein carries its ordinary meaning in the art, referring to addition of flotation reagents to the ore pulp prior to flotation.

We claim:

1. A method for the processing of mineral ore comprising:

forming ore pulp suitable for froth flotation processing, conditioning said ore pulp with a collector comprising a mixture of a thiol and the corresponding oxidized thiol, wherein said thiol and said corresponding oxidized thiol are introduced into said ore pulp by atomisation, and thereafter subjecting said pulp to flotation processing.

2. A method according to claim 1 wherein the ratio of thiol to dithiol in said collector is selected so as to provide optimum mineral recovery and selectivity.

3. A method according to claim 1 wherein said thiol is partially oxidized electrochemically to provide a mixture of said thiol and a corresponding dithiol.

4. A method according to any one of claims 1, 2 or 3 wherein the thiol collector is a xanthate, dithiophosphate, dialkyl thionocarbomate, mercaptan, mercaptobenzothiazole or thiocarbanilide.

5. A method according to claim 1 wherein said thiol is a xanthate and said oxidized thiol is an xanthogen.

6. A method according to any one of claims 1, 2 or 5 wherein the ore is a sulphide mineral ore or a sulphide mineral containing ore.

7. A method for the processing of mineral ore, comprising:

atomizing a collector solution comprising a thiol collector and an oxidized thiol collector to form an atomized solution;

contacting the atomized solution with a slurried feed material comprising valuable minerals to form a conditioned slurried feed material; and subjecting the conditioned slurried feed material to flotation to form a product comprising the valuable minerals.

8. A method according to claim 7, wherein the oxidized thiol collector is a dithiol compound.

9. A method according to claim 7, wherein the atomized solution comprises a plurality of droplets having a diameter ranging from about 1 to about 500 microns.

10. A method according to claim 7, wherein the thiol collector is selected from the group consisting of xanthate, dithiophosphate, dialkyl thionocarbamate, mercaptan, mercaptobenzothiazole, thiocarbanilide, and mixtures thereof.

11. A method according to claim 7, wherein the atomizing step comprises:

forming a first solution comprising a thiol collector and oxidizing a portion of the thiol collector to form the collector solution.

12. A method according to claim 11, wherein the oxidizing step is performed electrochemically.

13. A method for the processing of mineral ore, comprising:

forming a collector solution comprising a first collector that is insoluble in a slurried feed material and a second collector that is soluble in the slurried feed material into an atomized solution comprising a plurality of droplets of the collector solution;

contacting the atomized solution with the slurried feed material comprising valuable minerals to form a conditioned slurried feed material; and subjecting the conditioned flurried feed material to flotation to form a product comprising the valuable minerals wherein the first collector is dixanthogen and the second collector is a xanthate.

14. A method according to claim 13, wherein the plurality of droplets having a diameter ranging from about 1 to about 500 microns.

15. A method according to claim 13, wherein the collector solution comprises from about 6 to about 14% by weight of the first collector.

16. A method for the processing of mineral ore, comprising:

forming a collector solution comprising a first collector that is insoluble in a slurried feed material and the second collector that insoluble in the slurried feed material into an atomized solution comprising a plurality of droplets of the collector solution;

contacting the atomized solution with a slurried feed material comprising valuable minerals to form a conditioned slurried feed material; and subjecting the conditioned slurried feed material to flotation to form a product including the valuable minerals, wherein the forming step comprises:

providing a first solution comprising a thiol collector and oxidizing a portion of the thiol collector to form the collector solution.

17. A method according to claim 16, wherein the oxidizing step is performed electrochemically.

* * * * *